United States Patent [19]

Benson

[11] 4,232,607

[45] Nov. 11, 1980

[54] CENTRIFUGAL BALL CAM LOCKING DEVICE

[75] Inventor: Willard R. Benson, Dover, N.J.

[73] Assignee: The United States of America as represented by the Secretary of the Army, Washington, D.C.

[21] Appl. No.: 930,083

[22] Filed: Aug. 1, 1978

[51] Int. Cl.[3] ..... F42B 11/22

[52] U.S. Cl. ..... 102/56 R; 102/59; 102/69

[58] Field of Search ..... 102/69, 56, 59, 37.6, 102/34.4, 35.4, 231, 237; 244/3.23

[56] References Cited

U.S. PATENT DOCUMENTS

| | | | |
|---|---|---|---|
| 1,305,216 | 5/1919 | Janes | 102/59 |
| 4,159,679 | 7/1979 | Eneman | 102/237 |

FOREIGN PATENT DOCUMENTS

| | | | |
|---|---|---|---|
| 2237939 | 2/1974 | Fed. Rep. of Germany | 102/37.6 |

*Primary Examiner*—Harold J. Tudor

*Attorney, Agent, or Firm*—Nathan Edelberg; Robert P. Gibson; Max Yarmovsky

[57] ABSTRACT

A plurality of inertially responsive balls are disposed intermediate a housing of a spin stabilized projectile and a critically angled cam incline member for preventing the shift of stacked cargo during projectile flight. The combination of projectile spin and critical cam angle of the incline member is used to provide centrifugal and holding forces of sufficient magnitude to produce a self-locking taper effect which restricts loose stacked cargo members from causing destabilization and reduction in projectile range.

7 Claims, 7 Drawing Figures

CENTRIFUGAL BALL CAM LOCKING DEVICE

GOVERNMENTAL INTEREST

The invention described herein may be manufactured, used and licensed by or for the Government for governmental purposes without the payment to me of any royalty thereon.

BACKGROUND OF THE INVENTION

Various means have been used in the prior art to prevent shifting of loose cargo elements in a projectile. Projectiles are normally given spin about their longitudinal axes, by rifling in the gun barrel, canted fins, and/or gas jets in order to stabilize their flight, increase target range capabilities, and improve firing accuracy. Some projectiles contain groups or stacks of payload materials which for efficiency of space utilization are in the form of circular discs, either solid or annular having major surfaces adapted to be stacked together in an elongated cylindrical cavity of the projectile. The problem with these spinning cargo-carrying projectiles has been the unpredictability of their flight characteristic because of frequent shifting of the center of gravity of the projectile caused by varying degrees of looseness of the stacked cargo elements between each other and/or the projectile housing. The use of compliant means, such as springs, to take up the slack space within the stack was generally satisfactory only during preflight assembly, but was totally unsatisfactory where positive locking was required to overcome cargo movement during inflight high "G" stress conditions, because of their inherent resiliency. Fluid type dashpot damping devices have also not adequately prevented the looseness in stacked cargo elements of a projectile because of their inability to rapidly respond to rapidly changing high stress conditions encountered in projectile launch and flight.

SUMMARY OF THE INVENTION

The present invention relates to an improved centrifugal ball cam locking device for a spin stabilized projectile carrying stacked cargo elements. An incline cam member cam angle is critically set so that at a specific coefficient of friction the ball member and cam member act as a self-locking taper.

An object of the present invention is to provide a centrifugal ball cam self-locking taper device for a spin stabilized projectile which will prevent shifting of the projectiles center of gravity during its flight.

Another object of the present invention is to provide a centrifugal ball cam locking device for a spin stabilized projectile to insure against appreciable looseness of cargo elements contained within the projectile warhead.

Another object of the present invention is to provide a centrifugal ball cam locking device wherein the spinning of the projectile, inertial movement of balls in response to centrifugal forces and critical angle of a cam incline member operate to act as a self-locking taper cargo tightening means.

A further object of the present invention is to provide a centrifugal ball cam locking device wherein the frictional forces between inertially responsive balls and projectile housing and a critically inclined cam member prevent cargo shifting during projectile launch and flight.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals denote like parts of the drawings.

DESCRIPTION OF THE PREFERRED EMBODIMENTS

Figure 1:
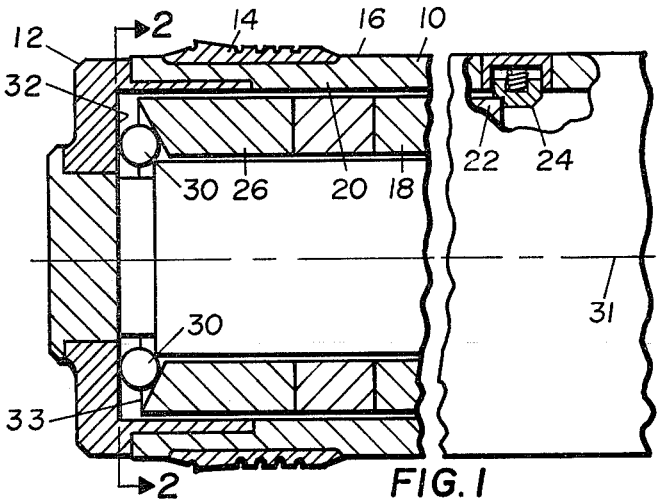
FIG. 1 is a partial longitudinal diametrical cross-sectional view of a projectile carrying stacked annular cargo members before launch.
Figure 2:
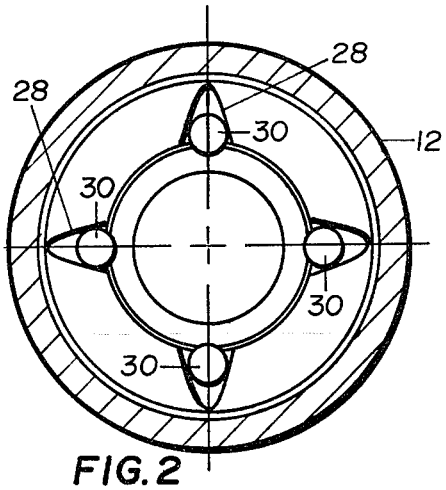
FIG. 2 is a partial cross-sectional view taken along line 2—2 of FIG. 1.
Figure 3:
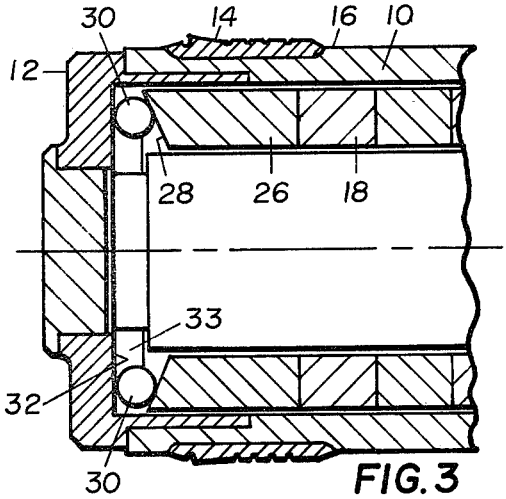
FIG. 3 is a partial longitudinal cross-sectional view of the projectile shown in FIG. 1 after launch.

Referring now to FIG. 1–3 a cylindrical projectile housing 10 has a cup shaped base member 12 fixedly attached thereto and an annular rifling ring 14 peripherally disposed in the housing exterior wall 16 of housing 10. A plurality of annularly shaped stacked cargo elements 18 are slidably positioned in housing cylindrical cavity 20. A forward cargo end 22 is fixedly held by a detent means 24. The annular cargo rear end member 26 has a plurality of radially positioned inclined grooved cargo cam surfaces 28 therein which help position inertially responsive steel balls 30 between cargo cam surfaces 28 and the base interior rear wall 32. An outwardly convergent space 33 is created between rear wall 32 and the inclined surface 28.

Figure 5:
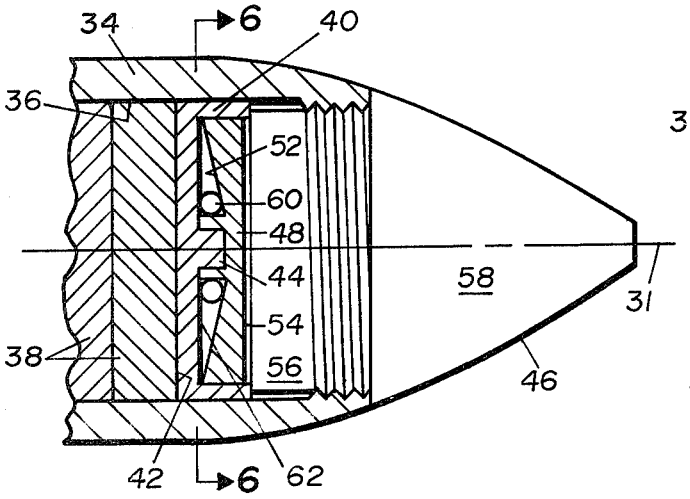
FIG. 5 is a partial cross-sectional view of an alternate embodiment of the subject invention wherein the stacked cargo is in the form of discs or plates.
Figure 6:
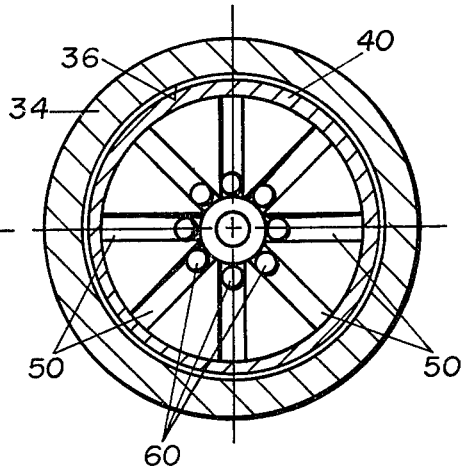
FIG. 6 is a partial cross-sectional view of taken along line 6—6 of FIG. 5.

Referring now to FIGS. 5 and 6, an alternate embodiment, a cylindrical projectile housing 34 has an axially disposed central cargo cavity 36 in which are slidably positioned a plurality of disc shaped cargo members 38. A cup shaped pusher plate 40 is in abutment with the cargo forward end 42 and has an axial boss 44 protruding toward the ogive end 46 of the projectile. A grooved incline cam member 48 has a plurality of radially disposed grooves 50 located in an inclined cam face 52 and a flat forward end 54 in abutment with a rear end 56 of fuze 58. A steel ball 60 is operatively rotatably positioned intermediate an interior bottom wall 62 of pusher plate 40 and each of the radial grooves 50. A conventional base member, not shown in FIG. 5 but similar to base member 12 shown in FIGS. 1 and 3, restrains the cargo elements 38 on the rear end.

Figure 4:
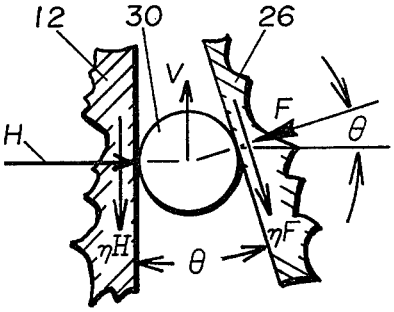
FIG. 4 is a drawing showing the forces being exerted on an inertially responsive ball member.
Figure 7:
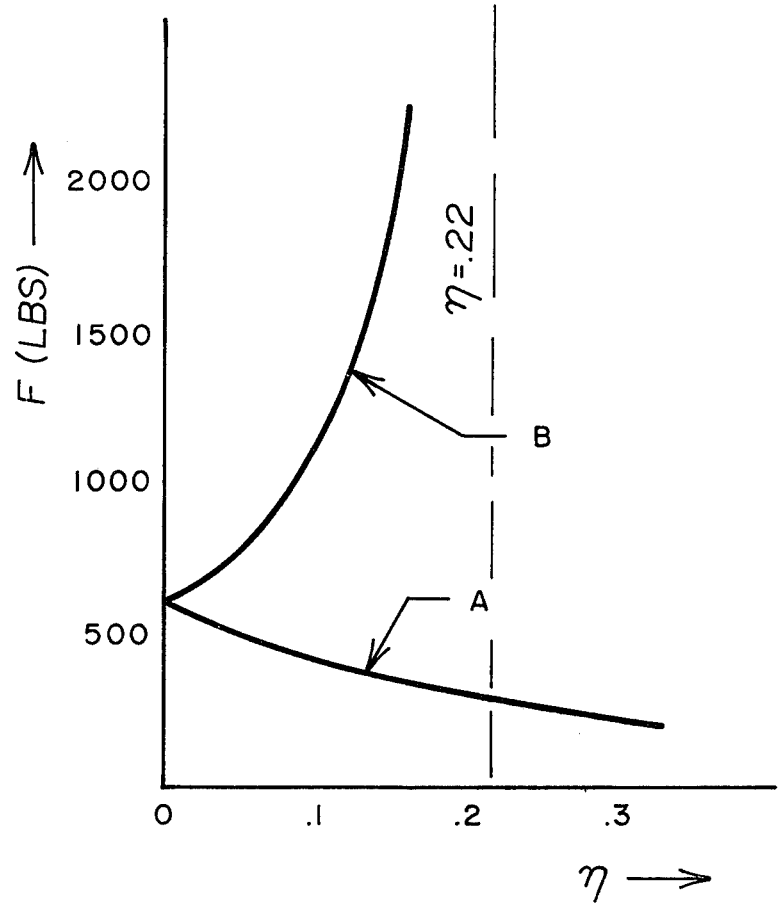
FIG. 7 is a plot of the forces acting to cam a ball member in forward and back directions versus increasing coefficient of friction.

Referring now to FIGS. 4 and 7, longitudinal force created by each ball 30 can be shown to be:

$$\frac{H}{V} = \frac{(1 - \eta \tan \theta)}{2\eta + \tan \theta - \eta^2 \tan \theta} \quad (1)$$

where $V = mw^2r$ m = mass of a ball w=angular acceleration of the projectile
r=radial distance of ball from the spin axis of the projectile
$\eta$=coefficient of friction
$\theta$=angle of incline
H=the holding force
for small $\theta$'s and $\eta$'s $$\frac{H}{V} = \frac{(1 - \eta \tan \theta)}{(2\eta + \tan \theta)} \quad (2)$$

The force required to cam ball 30 back toward the spin axis of the projectile can be shown to be:

$$F \sin \theta < V + \eta H + \eta F \operatorname{Cos} \theta \quad (3)$$

where $$F(\operatorname{Cos} \theta + \eta \operatorname{Sin} \theta) = H \quad (4)$$

and $$\therefore H \frac{(\operatorname{Sin} \theta - \eta \operatorname{Cos} \theta)}{(\operatorname{Cos} \theta + \eta \operatorname{Sin} \theta)} - \eta H > V \quad (5)$$

and to cam ball back $$H > \frac{V}{\left[\frac{(\operatorname{Sin} \theta - \eta \operatorname{Cos} \theta)}{(\operatorname{Cos} \theta + \eta \operatorname{Sin} \theta)} - \eta\right]} \quad (6)$$

FIG. 7 shows a first curve A, using equation (2), which represents a plot of the force per ball 30, acting to cam the cargo element 6 of FIG. 3 in a forward direction for various selected coefficient of friction values $\eta$, at specific values of angular acceleration, for a known ball mass, at a given radial distance from projectile longitudinal spin axis 31, and where the incline angle $\theta$ is equal to 25°. A second curve B has been plotted, using equation (6) above, to show the effects of the ball cam back force requirement for the same values of n, w, r and $\theta$. It should be noted that the holding force (H) for a given coefficient of friction n between the ball 30 and an interior base wall 32, varies as the square of the spin of the projectile. For a given spin rate ($w^2$) the holding force (H) falls off as the coefficient of friction n increases. As shown by plot A of FIG. 7 the ball force acting to cam the cargo rings forward likewise decreases with increasing coefficient of friction. The fact that the holding force varies as the square of the spin rate $w^2$ is highly desireable, since the cause of erratic flight is generally also proportional to spin rate squared. Thus if the projectile subsequently flies well at the highest spin rate one can expect the projectile to be stabilized at lower values of spin rate. The fact that the holding force (H) drops off as a function of an increase in the coefficient of friction is not at all detrimental since less force is needed to restrain relative motion of the internal load as friction increases. In addition, as the coefficient of friction goes up the ball cam device approaches the characteristics of a self-locking taper. From FIG. 7 we see that as the coefficient of friction increases, the force to cam the ball 30 back toward the spin axis 31 increases exponentially and at a coefficient of friction of 0.22 the force approaches very high values. This self-locking taper characteristic gives the cam elements of the apparatus shown in FIGS. 1–6, a dynamic self-adjusting shim like quality. It also tends to restrict cocking of the cargo elements 18 and 38 and to restrain their movement during flight. These movements of cargo have been substantialed as being one of the probable causes for erratic flight behavior, reduction in projectile range capability, and loss of ability to hit a selected target.

In operation when the projectiles shown in FIGS. 1–3 and 5, 6 are launched, spin is imparted to the projectile by rifling band 14 which results in centrifugal forces acting on balls 30 and 60, due to the projectile's spin. The centrifugal force pushes the balls in a direction radially away from the projectile's longitudinal spin axis 31 and exerts a longitudinal force against the bottom of the cargo elements. The forward caming action of the balls 30 and 50 against the incline grooves 28 and 50 respectively and the self-locking taper feature of the ball and incline cam, because of the critical selection of the inclined cam angle $\theta$, material selected having a given coefficient of friction, will effectively restrict the cargo from substantially all subsequent undesired fore and aft longitudinal motion. The friction between individual cargo element and between cargo elements and the interior wall surfaces of the projectile cavity will also aid in freezing the cargo load from lateral or radial motion and relative rotational motion.

The above described embodiments may be modified to increase the radial holding power by use of a smaller cam angle $\theta$ or a heavier density ball. For example, the use of a tungsten ball in place of a steel ball would increase the radial resistance by a factor of approximately 4. Where there is a possibility of ball failure because of excessive stress, a roller or wedge system could be used.

While there has been described and illustrated specific embodiments of the invention, it will be obvious that various changes, modifications and additions can be made herein without departing from the field of the invention which should be limited only by the scope of the appended claims.

I claim:

1. A centrifugal cam locking apparatus for a spin stabilized projectile comprises:

a cylindrically shaped housing having a longitudinal spin axis and a coaxial housing cavity;

a stack of circularly shaped cargo members contiguously disposed in said housing cavity;

stop means operatively disposed in said housing adapted to engage one end of said stack of cargo members for preventing longitudinal movement of said cargo members in a first longitudinal direction;

base member means fixedly attached to said housing for restraining the other end of said stack of cargo members for moving in a second longitudinal direction;

cam means, slidably disposed in said housing cavity having an inclined cam surface positioned at a critical angle $\theta$ with respect to a normal to said longitudinal spin axis, for restraining said stack of cargo members in fore and aft longitudinal movement by acting as a self-locking taper;

spin responsive means which moves radially outward in response to projectile spin, operatively positioned in abutment with said inclined cam surface for exerting a longitudinal force against one end of said stack of cargo members in response to projectile spin and for providing a holding force for substantially eliminating looseness of said stack of cargo members within said housing cavity which causes eratic projectile flight, and, said critical angle of incline $\theta$ for said cam means and coefficient of friction "$\eta$" for said base member means and said spin responsive means are selected to provide cam back force which increases exponetially with increasing values of coefficient of friction and cam forward forces which decrease exponentially with increasing coefficient of friction.

2. A centrifugal cam locking apparatus as recited in claim 1 wherein said base member means includes a cup shaped member having a base interior rear wall spaced from said other end of said stack of cargo members.

3. A centrifugal cam locking apparatus as recited in claim 2 wherein said cam means includes:

a cargo rear end member having a plurality of radially positioned inclined grooves adapted for positioning therein said spin responsive means.

4. A centrifugal ball cam locking apparatus as recited in claim 3 wherein said cargo rear end member includes:

an annular member having a first end surface engaging another end of said stack of cargo members, and a second end surface spaced from said base interior rear wall, said interior rear wall and said second end surface being inclined toward and away from each other to form an outwardly convergent space therebetween; and at least one inertial element disposed in an inner portion of said outwardly convergent space, said inertial element adapted to move outwardly by centrifugal force during the projectile spin stabilized flight, to force said annular member axially against said stack of cargo members and to restrain said stack of cargo members from fore and aft movement, thereby eliminating any looseness in said stack of cargo members which contribute to said projectile's fight instability.

5. A centrifugal cam locking apparatus as recited in claim 4 wherein said spin responsive means is a spherical ball made of steel.

6. A centrifugal cam locking apparatus as recited in claim 5 wherein spin responsive means is a spherical ball having a density greater than steel.

7. A centrifugal cam locking apparatus as recited in claim 1 wherein said critical angle $\theta$ is smaller than 25° and said coefficient of friction $\eta$ is larger than 0.22.

* * * * *